United States Patent [19]

Blood

[11] 4,142,719

[45] Mar. 6, 1979

[54] GOLF TEE INSERTION DEVICE

[75] Inventor: Frank X. Blood, St. Louis, Mo.

[73] Assignee: The ZIT Corporation, St. Louis, Mo.

[21] Appl. No.: 762,773

[22] Filed: Jan. 25, 1977

[51] Int. Cl.[2] ..... A63B 57/00

[52] U.S. Cl. ..... 273/33

[58] Field of Search ..... 273/32 B, 32 D, 32 F, 273/33, 162 C, 162 E; 294/19 A

[56] References Cited

U.S. PATENT DOCUMENTS

| | | | |
|---|---|---|---|
| 1,632,652 | 7/1927 | Czichas | 273/162 C |
| 1,852,956 | 4/1932 | Czichas | 273/162 C |
| 1,902,682 | 3/1933 | Walrath | 273/33 |
| 2,606,764 | 8/1952 | Mason | 273/33 |
| 2,609,198 | 9/1952 | Armstrong | 273/33 |
| 3,074,719 | 1/1963 | McKee | 273/33 |
| 3,186,593 | 6/1965 | Miotke | 273/32 D |
| 3,671,037 | 6/1972 | Murdock, Jr. | 273/33 |

*Primary Examiner*—Richard C. Pinkham
*Assistant Examiner*—T. Brown
*Attorney, Agent, or Firm*—Henry Croskell

[57] ABSTRACT

A device is provided for facilitating the insertion of a golf tee into the ground under controlled conditions of height and angulation independent of ground surface conditions. The device permits controlled golf tee insertion without bending or stooping through the use of a tee holding head wherein the tee is held in place by spaced-apart arm or spring elements extending downward from the outer diameter of a terminal end of a rod housed in a height adjustment sleeve, the sleeve or chamber is provided with spaced apart cutouts which receive the spring arm elements and allow them to be forced apart when a tee head is forced therebetween, the rod having a bearing surface which is substantially contoured to fit the concave upper surface of a standard golf tee head. The height adjustment sleeve, spaced-apart arm elements, vertical tee alignment and contoured bearing surface permit the tee to be inserted into the ground to a predetermined indicated tee height without disturbing the initial positioning and alignment of the tee due to the action of kinetic energy resulting from insertion thrust. The ground friction overcomes the holding friction exerted on the tee by the insertion device once the tee has been inserted into the ground and the insertion device is lifted up and away from the ground.

10 Claims, 6 Drawing Figures

GOLF TEE INSERTION DEVICE

BACKGROUND OF THE INVENTION

A golfer's game is affected by many variables. One of these is the ease of tee placement, and the extent to which a tee is positioned above the ground. When the ground is hard, insertion of a golf tee into the ground is often difficult and frustrating. This invention relates to a device for mechanically setting a tee into the ground so that the crown of the tee extends a preselected height above the ground regardless of the condition of the ground or the length of the tee.

Many types of tee setters and positioners are presently available. These available devices, however, have structural disadvantages which have militated against their being readily accepted by golfers. Hence, it is an object of this invention to provide a golf tee insertion device that is neither structurally complex nor expensive to manufacture, but is nevertheless sufficiently convenient and accurate that it will be more readily accepted by today's golfers.

One of the presently available types of tee setters requires the golfer to retain the tee in the device with his finger while the tee is being inserted into the turf. This can result in the tee being cocked during insertion into the ground so that the thusly set tee is improperly aligned. Also, particularly when used to set tees in hard ground, these devices tilt off the tee and may result in painful injuries to the golfer's finger. Hence, it is another object of this invention to provide a device for setting a tee so that its shank is substantially perpendicular to the ground and wherein the setting operation is accomplished without injury to the golfer.

Other types of golf tee positioners, while providing structure for more suitably guiding the tee, have not been adapted for convenient removal of the device from the tee after it has been set. Hence, it is another object of this invention to provide a tee setter and positioner of a type which not only meets the above noted objects, but which is also readily disengageable from the tee after it is set and positioned.

Still other types of tee setters are comprised of so many individual parts that they are simply too complex to be practical. In this respect, they are too expensive to manufacture on any type of a practical mass production basis. Some of the above mentioned types attempt to accomplish more than insertion of the golf tee into the ground and in so doing, impose operating complications that require unusual skill to operate and thereby fail to effectively accomplish any of their desired ends and particularly fail therefore to be useful to the average golfer for the task of inserting a tee into the ground. Also, in order to be useful, tee setters of the type contemplated must be suited for rough treatment. That is, they must be able to withstand being merely tossed into a golf bag and must be structured so that parts cannot be removed or lost thus depriving the device of its utility. Consequently, it is another object of this invention to provide a golf tee insertion device that is sufficiently accurate but still simple and sturdy enough to withstand the rugged use to which it will be subjected by the golfer.

Accordingly, an object of the present invention is to provide a golf tee insertion device to be used by a golfer in driving a golf tee vertically into the ground with a predetermined exposure height.

It is also an object of this invention to provide a simple-to-use device which is readily usable by the average golfer without development of any special skills in its use.

Another object of this invention is to provide a rugged and reliable device for facilitating the insertion of a golf tee into the ground without need of the player stooping or bending in the course of such operation.

Still another object of this invention is to provide a golf tee insertion device in the nature of a golfing accessory which may be carried loose in the golf bag with the clubs and which is effective to insert tees into hardened ground by a simple vertical thrust of the device.

Yet another object of this invention is to provide a golf tee insertion device which may be inexpensively manufactured and which is characterized by dependable and simple operation over a long period of use.

Other objects and advantages of the present invention will be apparent to those skilled in the art from a review of the attached drawing and specification when considered in its entirety.

SUMMARY OF THE INVENTION

In accordance with principles of the invention, a golf tee insertion device for facilitating the placing of a golf tee in the ground is disclosed, the device comprised of a shaft extension and a tee holding head, the shaft extension having the tee holding head axially affixed by fastener means to a terminal end, the tee holding head comprised of a rod having a first end portion axially affixed to the terminal end of the shaft extension and a second end portion having a tee holding head axially affixed to the second end having a bearing surface head contoured substantially to the recessed upper surface of a standard golf tee, said second end portion terminating in two or more spaced-apart arm or spring elements having interior gripping means or tips conforming to the shape of the upper section of a standard golf tee, said arm or spring elements extending from the rod outer diameter surface of the bearing surface, said rod having machine screw threads on exterior portion accommodating a sleeve having matching machine screw threads, said sleeve axially movable along the rod exterior past an affixed scale which directly indicates placed tee crown height above the ground.

BRIEF DESCRIPTION OF THE DRAWINGS

Embodiments of the present invention are fully described below and are illustrated by accompanying drawing in which.

DETAILED DESCRIPTION

Figure 1:
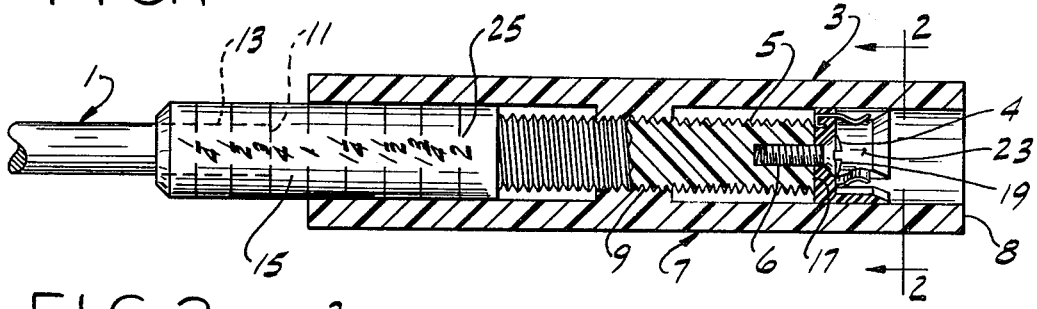
FIG. 1 is a side view of the golf tee insertion device with a sectional view of the adjustment sleeve and the tee holding head.

Referring to the drawings by characters of reference, there is shown in FIG. 1 a golf tee insertion device comprising in general a shaft extension 1, a tee holding head 3 and a head portion 4. The tee holding head 3 is axially affixed to the shaft extension 1 through fastening means 13. Tee holding head 3 is comprised of a height adjustment sleeve 7 having a threaded interface 9 with rod 5, the terminal end 8 of sleeve 7 providing the ground stop or rest for the tee insertion device. Rod 5 first end portion 15 is axially affixed to the shaft terminal end 11 through fastener 13, rod 5 second end portion 17 having a bearing surface contoured head 19 and spaced-apart spring elements 20 or flexible arm elements 21. Rod 5 has mounted thereon a tee height exposure gauge means 25 which indicates by the positional relationship of sleeve 7 and rod 5 the distance from bearing surface head 19 to the sleeve terminal end 8.

Figure 2:
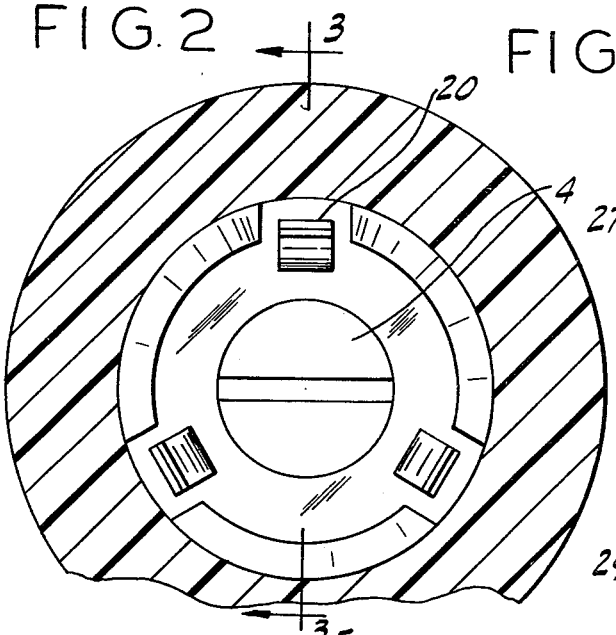
FIG. 2 is a cross sectional view taken along the line of 2—2 of FIG. 1.
Figure 3:
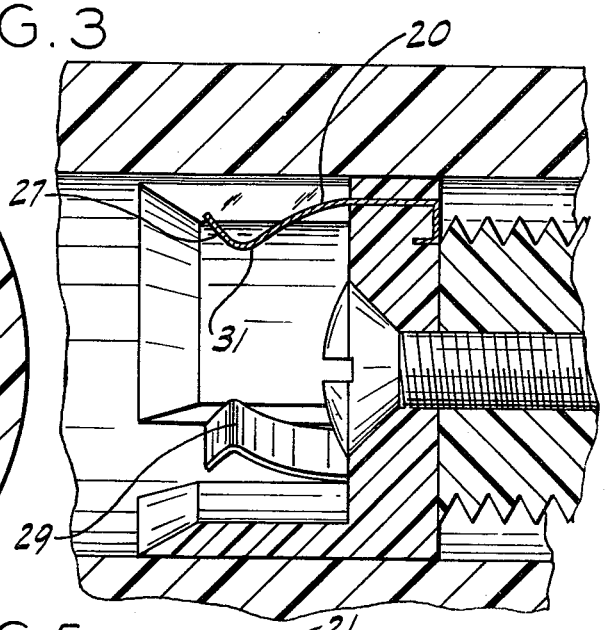
FIG. 3 is a cross sectional view taken along the line of 3—3 of FIG. 2.

The cross sectional views of FIGS. 2 and 3 of the tee holding head portion 4 illustrate the spaced-apart spring elements 20 in more detail inclusive of the sloped leading edges 29 which act as guides to direct the crown 35 of a golf tee into the tee holding head 3. The inwardly sloped spring elements 20 have holding portions 31 which protrude from the elements. The spring elements 20 flex outward as the crown 35 of a golf tee is inserted and guided past sloped leading edges 27 coming to rest against the contoured head bearing surface 19 and spring elements 20 holding portion 29. Flexibility and spring action of the elements 20 and friction between the holding portions 29 and the crown 35 of the golf tee imparts a retaining force which hold the tee in the holding head 3. The retaining force is only sufficient to retain the tee in position until it is inserted into the ground. Upon insertion of the tee into the ground which is enhanced by kinetic energy due to weight of the device and a modest downward thrust, ground friction acting upon the inserted stem 37 of the tee overcomes the retaining force of the tee holding head 3, releasing the tee from the spring element 20 as the device is withdrawn vertically upward.

Figure 4:
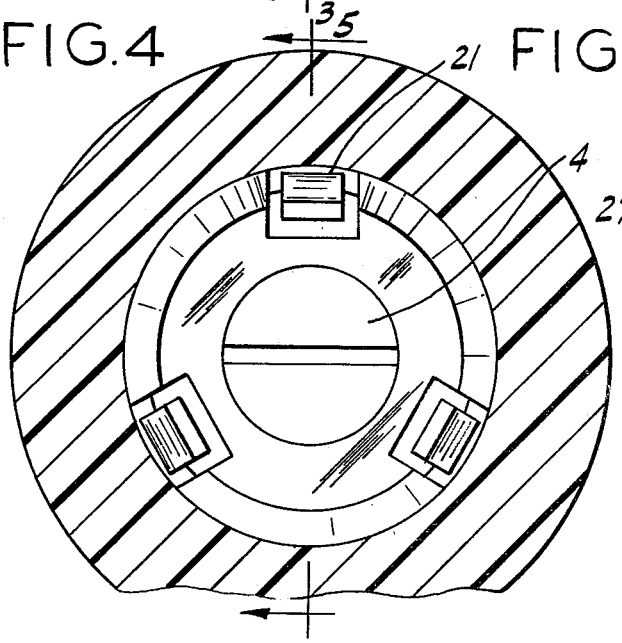
FIG. 4 is a cross sectional view taken along the line 2—2 of FIG. 1 for the purpose of illustrating optional arm elements.
Figure 5:
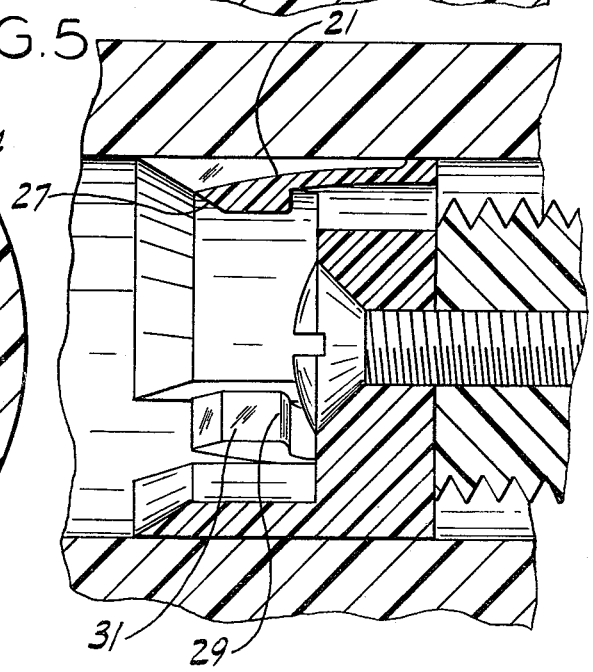
FIG. 5 is a cross sectional view taken along the line of 5—5 of FIG. 4.

The cross sectional views of FIGS. 4 and 5 of the tee holding head portion 4 illustrate the spaced-apart arm elements 21 in more detail inclusive of the sloped leading edges 27 which act as guides to direct the crown 35 of a golf tee into the tee holding head 3. The inwardly sloped arm elements 21 have holding portions 29 which protrude from the arm elements 21 shafts 30. The flexable arm elements 21 flex outward as the crown 35 of a golf tee is inserted and guided past sloped leading edges 27 coming to rest against the contoured head bearing surface 19 and arm elements 21 holding surface 31. Flexibility and spring action of the arm elements 21 and friction between the holding portions 29 and the crown 35 of the golf tee imparts a retaining force which hold the tee in the holding head 3. The retaining force is only sufficient to retain the tee in position until it is inserted into the ground. Upon insertion of the tee into the ground which is enhanced by kinetic energy due to weight of the device and a modest downward thrust, ground friction acting upon the inserted shaft of the tee overcomes the retaining force of the tee holding head 3 releasing the tee from the arm element 21 as the device is withdrawn vertically upward.

Figure 6:
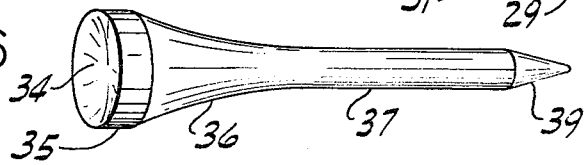
FIG. 6 is a side view of a typical modern golf tee.

A typical modern golf tee is shown in FIG. 6 for comparative purposes. The functions of the tee holding head 3 elements can more readily be appreciated when considered with an available side view of the golf tee of FIG. 6 and the various geometric elements shown therein.

The flat surface at the base of the tee holder head portion 4 and the oval contoured bearing surface 19 is preferably the head of an ordinary No. 8 oval head machine attachment screw 6 which conforms generally to the upper surface of the golf tee 33. These contours provide the bearing surfaces to drive the tee into the ground while exerting force uniformly on the tee head thereby minimizing potential damage to the head of the golf tee as it is driven into the ground.

The interior golf tee head chamber 23 at the base of the tee holding head portion referred to above acts as a restraining member through the function of the spaced insertion guide elements 20 and 21, thus limiting lateral movement of the tee crown 35 in the tee holding head 3 as the tee is driven into the ground. The head chamber 23 defined by a wall in which guide elements 20 and 21 are positioned. Excessive lateral movement by the tee could otherwise result in damage to the tee, arm or spring elements either of which would prevent a vertical placement of the golf tee into the ground.

The contour of the shaft extension and the size of the tee holder are designed to permit easy adjustment of the height adjustment by rotation of the height adjustment sleeve on the shaft extension or rod between clockwise and counterclockwise extremities and limits the travel of the height adjustment sleeve to the range of the direct height indicated on the scale.

It is intended that the device be used to insert a golf tee into the ground after which time the device would be removed and returned to the golf bag. A golf ball must then be placed upon the tee, ready to be driven by a golf club in the usual manner.

The device is designed to use standard commercially available golf tees. The tee holder is designed to lightly hold a tee in axial alignment with the shaft extension and rod. In use, a tee is inserted into the tee holder, the height adjustment sleeve is positioned to obtain desired placed tee height, the device is held vertically above the desired location of the placed tee with the tee pointing down to the chosen location and the device is thrust briskly vertically downward driving the tee into the ground by kinetic energy imparted to the device by brisk downward movement. The lower edge of the height adjustment sleeve approaches and ultimately contacts the ground interrupting further downward movement. The device is then withdrawn vertically upward and ground friction acting upon the inserted tee stem retains the tee in position in the ground, thereby releasing the tee from the tee holder. The tee is now positioned as desired, ready for placement of a golf ball on the tee, to be driven by a golf club.

The shaft extension or rod has an indicating scale which is used to indicate directly by position of the upper edge of the height adjustment sleeve the height of the top of the placed tee above ground elevation. The height of the placed tee is readily adjustable by rotating the height adjustment sleeve on the rod. If the height adjustment sleeve is rotated to its clockwise extremity, the placed tee exposure height will be about 0.3 inches above ground elevation. If the height adjustment sleeve is rotated to its counterclockwise extremity, the placed tee exposure height will be about 1.7 inches above ground elevation. The full range of tee height adjustments between about 0.3 inches and about 1.7 inches is available.

The inventive golf tee insertion device provides at the terminal end of a shaft or handle, a tee holding head which holds the crown of a golf tee accomplished by use of two or more, preferably three equally spaced-apart spring or spring arm elements formed to conform to the shape of the upper exterior curved section of a standard golf tee. The tee holding head, shaft extension and rod can be formed of various materials of construction such as wood, metal, or plastic compositions or a combination of the same except for the spring or arm elements which preferably are constructed from metal or plastic having the necessary physical properties of strength, recoil and lack of fatigue.

Measurements taken from a representative cross section of commercially available golf tees indicates considerable variations in tee crown diameters, tee crown height and tapering pitch from the tee crown to the cylindrical stem. Averages for the tee crown diameters were found to be 0.473 inches for maximum average and 0.458 inches minimum averave with a mean average of 0.4655 inches. These variances clearly require that the tee holding head configuration and variable spring load must functionally serve a wide range of dimensions. The arm elements preferably present a sloped leading edge having an accepting end angle of from about 15° to about 30° from vertical and a holding portion having a height of from about 0.10 to about 0.15 inches and a curved surface having an approximate width of from about 0.10 to about 0.15 inches. The curved holding portion surfaces have tangent interior diameters of from about 0.40 to about 0.47 inches while the head portion outer wall has an internal diameter of about 0.50 inches. Both the arm element holding portions and spring element holding surfaces form an ID circumference of less than about 0.50 inches depending upon the nature of the spring or arm element as well as the holding force required to prevent misalignment or looseness of the golf tee within the holding head. The arm or spring holding surfaces extend beyond the bearing surface and can be constructed of sufficient lengths to grip the tee below the crown along the tapered portion or about the crown or both due to the variable needs of different commercially available golf tees.

The invention hereinabove described may be varied in construction within the scope of the claims, for the particular device selected to illustrate the invention is but one of many possible embodiments of the same. The invention, therefore, is not to be restricted to the precise details of the structures shown and described.

What I claim is:

1. A device for facilitating the placing of a golf tee in the ground, said device comprised of a hollow golf tee holder head defined by a head chamber and shaft head, the shaft having the tee holding head axially affixed by fastener means to a terminal end, the tee holding head comprised of a rod having a first end portion axially affixed to the terminal end of the shaft and a second end portion having a bearing surface head contoured substantially to the recessed upper surface of a standard golf tee, said second end portion terminating in an affixed head portion comprised of three or more equally spaced apart spring arm elements, each spring arm element being positioned in a cutout in a wall which define said head chamber, said elements having interior gripping surfaces conforming to the shape of the upper cross section of a standard golf tee head, said spring arm elements extending from the rod outer diameter surface of the bearing surface head, said rod having machine screw threads on an exterior portion accommodating a sleeve having matching machine screw threads, said sleeve axially moveable along the rod exterior.

2. A device according to claim 1 wherein the spring arm elements provide gripping surfaces at a point beyond the bearing surface head.

3. A device according to claim 1 wherein the spring arm elements have gripping surfaces which extend below the head of a golf tee positioned in the tee holding head.

4. A device according to claim 1 wherein the spring arm elements in combination with the head chamber wall provide an outwardly sloped receiving surface having an angle of about 15° to about 30° relative to the longitudinal axis of said shaft.

5. A device according to claim 1 wherein the axially moveable sleeve has a terminal end portion enclosing the tee holding head spring arm elements, said sleeve terminal portion having a terminal end which establishes the distance between the bearing surface and the ground.

6. A device according to claim 5 wherein a linear scale is attached thereto which illustrates by sleeve position a predetermined placed tee height.

7. A device according to claim 1 wherein the bearing surface head contoured substantially to the recessed upper surface of a standard golf tee is comprised of a screw head, said screw axially affixing the head portion to the rod.

8. A device according to claim 1 wherein the spring arm elements gripping surface define a circle having a diameter smaller than the diameter of the bearing surface.

9. A device according to claim 1 wherein the axially moveable sleeve has a restricted travel in relationship to the rod and bearing surface head of from about 0.3 inches to about 1.7 inches.

10. A device according to claim 1 wherein the contour of the tee holder acts as a guide to direct a golf tee head into the bearing surface and also, confines the tee head, which limits tee head lateral movement as the tee shaft is inserted into the ground.

* * * * *